United States Patent [19]

Horgan et al.

[11] Patent Number: 4,664,995

[45] Date of Patent: May 12, 1987

[54] ELECTROSTATOGRAPHIC IMAGING MEMBERS

[75] Inventors: Anthony M. Horgan, Pittsford; Alfred T. LaFrance, Macedon; Francis J. Wieloch, Penfield; Robert C. U. Yu, Webster, all of N.Y.

[73] Assignee: Xerox Corporation, Stamford, Conn.

[21] Appl. No.: 791,045

[22] Filed: Oct. 24, 1985

[51] Int. Cl.[4] ..... G03G 5/14

[52] U.S. Cl. ..... 430/59; 430/64; 430/69

[58] Field of Search ..... 430/59, 69, 64

[56] References Cited

U.S. PATENT DOCUMENTS 3,783,021 1/1974 York ..... 117/212
4,402,593 9/1983 Bernard et al. ..... 355/3
4,416,963 11/1983 Takimoto et al. ..... 430/69
4,464,450 8/1984 Teuscher ..... 430/59

*Primary Examiner*—John L. Goodrow
*Attorney, Agent, or Firm*—Peter H. Kondo

[57] ABSTRACT

An electrostatographic imaging member comprising at least one imaging layer capable of retaining an electrostatic latent image, a supporting substrate layer having an electrically conductive surface, and an electrically conductive ground strip layer adjacent the electrostatographic imaging layer and in electrical contact with the electrically conductive layer, the electrically conductive ground strip layer comprising a film forming binder, conductive particles and crystalline particles dispersed in the film forming binder and a reaction product of a bi-functional chemical coupling agent with both the film forming binder and the crystalline particles. This imaging member may be employed in an electrostatographic imaging process.

16 Claims, No Drawings

ELECTROSTATOGRAPHIC IMAGING MEMBERS

BACKGROUND OF THE INVENTION

This invention relates in general to electrostatography and, more specifically, to a flexible electrophotoconductive imaging member having an electrically conductive ground strip layer.

In the art of xerography, a xerographic plate comprising a photoconductive insulating layer over an electrically conductive layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Other electrostatographic imaging devices utilizing an imaging layer overlying a conductive layer include electrographic devices. For flexible electrographic imaging members, the conductive layer is normally sandwiched between a dielectric imaging layer and a supporting flexible substrate. Thus, generally, flexible electrophotographic imaging members generally comprise a flexible recording substrate, a thin electrically conductive layer, and at least one photoconductive layer and electrographic imaging members comprise a conductive layer sandwiched between a dielectric imaging layer and a supporting flexible substrate. Both of these imaging members are species of electrostatographic imaging members.

In order to properly image an electrostatographic imaging member, the conductive layer must be brought into electrical contact with a source of fixed potential elsewhere in the imaging device. This electrical contact must be effective over many thousands of imaging cycles in automatic imaging devices. Since the conductive layer is frequently a thin vapor deposited metal, long life cannot be achieved with an ordinary electrical contact that rubs directly against the thin conductive layer. One approach to minimize the wear of the thin conductive layers is to use a grounding brush such as that described in U.S. Pat. No. 4,402,593. However, such an arrangement is generally not suitable for extended runs in copiers, duplicators and printers.

Still another approach to improving electrical contact between the thin conductive layer of flexible electrostatographic imaging members and a grounding means is the use of a relatively thick electrically conductive grounding strip layer in contact with the conductive layer and adjacent to one edge of the photoconductive or dielectric imaging layer. Generally the grounding strip layer comprises opaque conductive particles dispersed in a film forming binder. This approach to grounding the thin conductive layer increases the overall life of the imaging layer because it is more durable than the thin conductive layer. However, such relatively thick ground strip layer are still subject to erosion and contribute to the formation of undesirable "dirt" in high volume imaging devices. Erosion is particularly severe in electrographic imaging systems utilizing metallic grounding brushes or sliding metal contacts.

Also, in systems utilizing a timing light in combination with a timing aperture in the ground strip layer for controlling various functions of imaging devices, the erosion of the ground strip layer by devices such as stainless steel grounding brushes and sliding metal contacts is frequently so severe that the ground strip layer is worn away and becomes transparent thereby allowing light to pass through the ground strip layer and create false timing signals which in turn can cause the imaging device to prematurely shut down. Moreover, the opaque conductive particles formed during erosion of the grounding strip layer tends to drift and settle on other components of the machine such as the lens system, corotron, other electrical components and the like to adversely affect machine performance. For example, at a relatively humidity of 85 percent, the ground strip layer life can be as low as 100,000 to 150,000 cycles in high quality electrophotographic imaging members. Also, due to the rapid erosion of the ground strip layer, the electrical conductivity of the ground strip layer can decline to unacceptable levels during extended cycling.

Thus, the characteristics of flexible electrostatographic imaging members utilizing ground strip layer exhibit deficiencies which are undesirable in automatic, cyclic electrostatographic imaging systems.

SUMMARY OF THE INVENTION

It is an object of the invention to provide an electrophotographic imaging member which overcomes the above-noted disadvantages.

It is an another object of this invention to provide an electrostatographic imaging member having extend life.

It is another object of this invention to provide an electrostatographic imaging member that resists the formation of products of erosion.

It is still another object of this invention to provide an electrostatographic imaging member which maintains conductivity for longer periods.

It is another object of this invention to provide an electrostatographic imaging member which remains opaque for longer periods.

The foregoing objects and others are accomplished in accordance with this invention by providing an electrostatographic imaging member comprising at least one imaging layer capable of retaining an electrostatic latent image, a supporting substrate layer having an electrically conductive surface, and an electrically conductive ground strip layer adjacent the electrostatographic imaging layer and in electrical contact with the electrically conductive layer, the electrically conductive ground strip layer comprising a film forming binder, conductive particles and crystalline particles disposed in the film forming binder and a reaction product of a bi-functional chemical coupling agent with both the film forming binder and the crystalline particles. This imaging member may be employed in an electrostatographic imaging process.

The supporting substrate layer having an electrically conductive surface may comprise any suitable rigid or flexible member such as a flexible web or sheet. The supporting substrate layer having an electrically conductive surface may be opaque or substantially transparent and may comprise numerous suitable materials having the required mechanical properties. For example, it may comprise an underlying insulating support layer coated with a thin flexible electrically conductive layer, or merely a conductive layer having sufficient internal strength to support the electrophotoconductive layer and ground strip layer. Thus, the electrically conductive layer may comprise the entire supporting substrate layer or merely be present as a component of the supporting substrate layer, for example, as a thin flexible coating on an underlying flexible support member. The electrically conductive layer may comprise any suitable electrically conductive material. Typical electrically conductive layers including, for example, aluminum, titanium, nickel, chromium, brass, gold, stainless steel, carbon black, graphite and the like. The conductive layer may vary in thickness over substantally wide ranges depending on the desired use of the electrophotoconductive member. Accordingly, the conductive layer can generally range, for example, in thicknesses of from about 50 Angstrom units to many centimeters. When a highly flexible photoresponsive imaging device is desired, the thickness of conductive metal layers may be between about 100 Angstroms to about 750 Angstroms. If an underlying flexible support layer is employed, it may be of any conventional material including metal, plastics and the like. Typical underlying flexible support layers include insulating non-conducting materials comprising various resins known for this purpose including, for example, polyesters, polycarbonates, polyamides, polyurethanes, and the like. The coated or uncoated supporting substrate layer having an electrically conductive surface may be rigid or flexible and may have any number of different configurations such as, for example, a sheet, a cylinder, a scroll, an endless flexible belt, and the like. Preferably, the flexible supporting substrate layer having an electrically conductive surface comprises an endless flexible belt of commercially available polyethylene terephthalate polyester coated with a thin flexible metal coating.

The electrostatographic imaging layer may comprise an electrophotographic imaging layer or and electrographic imaging layer. Any suitable electrographic imaging layer may be employed. Typical electrographic imaging layers are high dielectric layers which will retain a deposited electrostatic latent image until development is completed. Examples of electrographic imaging layers include, for example, polycarbonate, polyvinyl butyral, acrylic, polyurethane, polyester, and the like.

If desired, any suitable charge blocking layer may be interposed between the conductive layer and the imaging layer if the imaging layer comprises an electrophotographic imaging layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicons and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability of the electrophotographic imaging layer is extended. The entire disclosure of U.S. Pat. No. 4,464,450 is incorporated herein by reference. The specific silanes employed to form the preferred blocking layer are identical to the preferred silanes employed to treat the crystalline particles of this invention. In other words, silanes having the following structural formula:

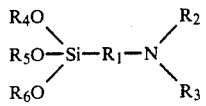

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylhethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

Any suitable technique may be utilized to apply the hydrolyzed silane solution to the conductive layer. Typical application techniques including spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms.

A preferred blocking layer comprises a reaction product between a hydrolyzed silane and a metal oxide layer of the electrically conductive layer, the hydrolyzed silane having the general formula:

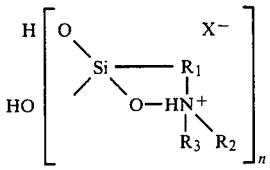

I.

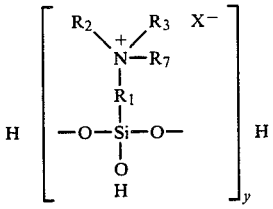

II.

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1, 2, 3 or 4, and y is 1, 2, 3 or 4. The imaging member is prepared by depositing on the metal oxide layer of the conductive layer a coating of an aqueous solution of the hydrolyzed silane at a pH between about 4 and about 10, drying the reaction product layer to form a siloxane film and applying the generating layer and charge transport layer to the siloxane film.

The hydrolyzed silane may be prepared by hydrolyzing a silane having the following structural formula:

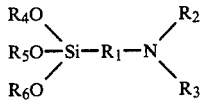

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)-amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl-3-amino) propyl triethoxysilane, N,N-dimethylamino phenyl triethoxy silane, N-phenylaminopropyltrimethoxy silane, trimethoxy silylpropyldiethylene triamine and mixtures thereof.

If $R_1$ is extended into a long chain, the compound becomes less stable. Silanes in which R1 contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with akyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate general structure:

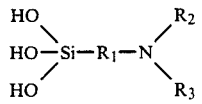

After drying, the siloxane reaction product film formed from the hydrolyzed silane contains larger molecules in which n is equal to or greater than 6. The reaction product of the hydrolyzed siane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed sialne to form an undesirable gel. Generally, dilute solutions are preferred for achieving thin coatings. Satisfactory reaction product films may be achieved with solutions containing from about 0.1 percent by weight to about 5 percent by weight of the silane based on the total weight of the solution. A solution containing from about 0.05 percent by weight to about 0.2 percent by weight silane based on the total weight of solution are preferred for stable solutions which form uniform reaction product layers. It is important that the pH of the solution of hydrolyzed silane be carefully controlled to obtain optimum electrical stability. A solution pH between about 4 and about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, ethylene glycol monomethyl ether, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total wieght of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depend upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and 10.

The reaction may be conducted under any suitable pressure including atmospheric pressure or in a vacuum. Less heat energy is required when the reaction is conducted at subatmospheric pressures.

One may readily determine whether sufficient condensation and cross-linking has occurred to form a siloxane reaction product film having stable electric chemical properties in a machine environment by merely wasing the siloxane reaction product film with water, toluene, tetrahydrofuran, methylene chloride or cyclohexanone and examining the washed siloxane reaction product film to compare infrared absorption of Si-O-wavelength bands between about 1,000 to about 1,200 $cm^{-1}$. If the Si-O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normallly not achievable even under the most severe drying or curing conditions. The hydrolyzed silane appears to react with metal hydroxide molecules in the pores of the metal oxide layer. This siloxane coating is described in U.S. Pat. No. 4,464,450, issued Aug. 7, 1984 to Leon A. Teuscher, the disclosure of this patent being incorporated herein in its entirety.

In some cases, intermediate layers between the blocking layer and any adjacent charge generating or photogenerating material may be desired to improve adhesion or to act as an electrical barrier layer. If such layers are utilized, they preferably have a dry thickness between about 0.01 micrometer to about 5 micrometers. Typical adhesive layers include film-forming polymers such as polyester, polyvinylbutyral, polyvinylpyrolidone, polyurethane, polymethyl methacrylate and the like. Other well known electrophotographic imaging layers include amorphous selenium, halogen doped amorphous selenium, amorphous selenium alloys including selenium arsenic, selenium tellurium, selenium arsenic antimony, halogen doped selenium alloys, cadmium sulfide and the like. Generally, these inorganic photoconductive materials are deposited as a relatively homogeneous layer.

Generally, as indicated above, the electrostatogaphic imaging member may comprise at least one electrophotographic imaging layer capable of retaining an electrostatic latent image, a supporting substrate having an electrically conductive surface, and an electrically conductive ground strip layer adjacent the electrophotographic imaging layer and in electrical contact with the electrically conductive layer, the electrically conductive ground strip layer comprising a film forming binder, conductive particles and crystalline particles dispersed in the film forming binder and a reaction product of a bi-functional chemical coupling agent with both the film forming binder and the crystalline particles. In the electrophotographic imaging member of this invention, the imaging member comprises an electrophotographic imaging layer capable of retaining an electrostatic latent image. The electrophotographic imaging layer may comprise a single layer or multilayers. The layer may contain homogeneous, heterogeneous, inorganic or organic compositions. One example of an electrophotographic imaging layer containing a heterogeneous composition is described in U.S. Pat. No. 3,121,006 wherein finely divided particles off a photoconductive inorganic compound is dispersed in an electrically insulating organic resin binder. The entire disclosure of this patent is incorporated herein by reference.

The electrophotographic imaging layer preferably comprises two electrically operative layers, a charge generating layer and a charge transport layer which is capable of capacitive displacement and which exhibits excellent flexibility.

Any suitable charge generating or photogenerating material may be employed as one of the two electrically operating layers in the multilayer photoconductive of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent of less by volume of the binder layer with no limitation on the maximum amount of photoconductor in the binder layer. Generally for generator layers containing an electrically active matrix or binder such as polyvinyl carbazole or poly(hydrozyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having this characteristic, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent be weight of a polymeric film forming resin in which the aromatic amine is soluble.

The charge transport layer forming mixture preferably comprises an aromatic amine compound of one or more compounds having the general formula:

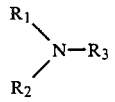

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

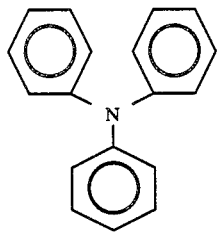

II. Bis and poly triarylamines such as:

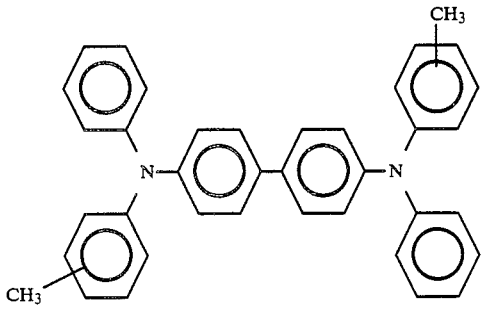

III. Bis arylamine ethers such as:

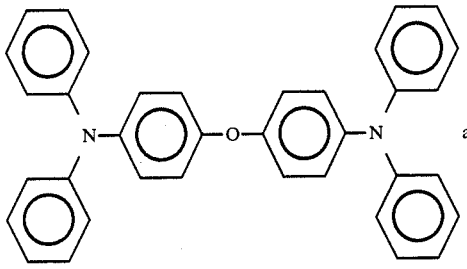

and

IV. Bis alkyl-arylamines such as:

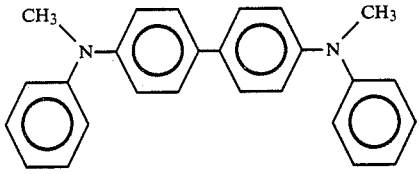

A particularly preferred aromatic amine compound has the general formula:

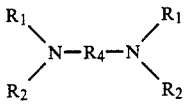

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

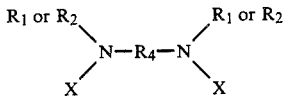

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenyl-methane, N,N'-bis(alkylphenyl-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Methylene chloride solvent is a preferred component of the charge transport layer coating mixture for adequate dissolving of all the components and for its low boiling point.

Alternatively, as previously mentioned, the active layer may comprise a photogenerated electron transport material, for example, trinitrofluorenone, poly-N-vinyl carbazole/trinitrofluorenone in a 1:1 mole ratio, and the like.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, and about 83 percent by weight methylene chloride. The methylene chloride can contain from about 0.1 ppm to about 1,000 ppm protonic or Lewis acid based on the of weight methylene chloride.

Optionally, an overcoat layer may also be utilized to improve resistance to abrasion. These overcoating layers may comprise organic polymers or inorganic polymers that are electrically insulating or slightly semi-conductive.

The electrically conductive ground strip layer is usually positioned adjacent the electrostatographic imaging layer and in electrical contact with the electrically conductive layer, the electrically conductive ground strip layer comprising a film forming binder, conductive particles and crystalline particles dispersed in the film forming binder and a reaction product of a bi-functional chemical coupling agent with both the film forming binder and the crystalline particles.

Any suitable film forming binder which reacts with the bi-functional chemical coupling agent may be utilized in the electrically conductive ground strip layer. For flexible imaging members, the thermoplastic resins should have $T_g$ of at least about 40° C. to impart sufficient rigidity, beam strength and nontackiness to the ground strip layer. The film forming binder should be a thermoplastic resin having reactive groups which will react with reactive groups on the coupling agent molecule. Typical reactive groups in resins include COOH, OH, vinyl, amino, amide, epoxide, carbonyl, and the like. Typical thermoplastic resins containing reactive groups include polycarbonates, polyesters, polyurethanes, acrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, and the like and mixtures thereof. The film forming binders preferably contain reactive groups selected from the group consisting of COOH and OH groups. Specific examples of resins having reactive groups that will react with bi-functional coupling agents include polycarbonate resin containing OH reactive groups such as Lexan from General Electric Co. and Merlon from Mobay Chemical Co., cellulose resins containing OH and COOH reactive groups, polyester resins containing COOH or OH reactive groups, and the like and mixtures thereof. A film forming binder of polycarbonate resin is particularly preferred because of its excellent adhesion to adjacent layers. A film forming binder mixture of from about 60 percent by weight and about 70 percent by weight polycarbonate resin based upon the total weight of the dried ground strip layer and from about 5 percent by weight and about 10 percent by weight percent ethylcellulose based upon the total weight of the dried ground strip layer is especially preferred as the film forming binder because of the improved mechanical and electrical properties achieved in the final ground strip layer such as toughness and uniform particle dispersion. Optimum results are achieved with a deposited ground strip layer film forming binder mixture comprising about 5–10 percent by weight ethylcellulose and about 20–30 percent by weight graphite based upon the total weight of the dried ground strip layer with the remainder being polycarbonate resin and crystalline particles.

Any suitable electrically conductive particles may be used in the electrically conductive ground strip layer of this invention. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and to ensure uniform dispersion of the particles throughout matrix of the dried ground strip layer. The concentration of the conductive particles to be used in the ground strip depends on factors such as the conductivity of the specific conductive particles utilized. Generally, the concentration of the conductive particles in the ground strip is less than about 35 percent by weight based on the total weight of the dried ground strip in order to maintain sufficient strength and flexibility for flexible ground strip layers. Excellent results have been achieved with graphite concentrations of about 25 percent by weight based on the total weight of the dried ground strip layer and about 20 percent by weight carbon black based on the total weight of the dried ground strip layer. Sufficient conductive particle concentration is achieved in the dried ground strip layer when the surface resistivity of the ground strip layer is less than about $1\times10^6$ ohms per square and when the volume resistivity is less than about $1\times10^8$ ohm cm. A volume resistivity of about $1\times10^4$ ohm cm is preferred to provide ample latitude for variations in ground strip thickness and variations in the contact area between the outer surface of the ground strip layer and the electrical grounding device. Thus, a sufficient amount of electrically conductive particles should be used to achieve a volume resistivity less than about $1\times10^8$ ohm cm. Excessive amounts of electrically conductive particles will adversely affect the flexibility of the ground strip layer for flexible photoreceptors. For example, a concentration of electrically conductive graphite particles greater than about 45 percent by weight or a concentration of electrically conductive carbon black particles greater than about 20 percent by weight begin to unduly reduce the flexibility of the electrically conductive ground strip layer due to the added presence of the treated crystalline particles. The conductive ground strip layer exhibits exceptionally long life on flexible imaging members which are cycled around small diameter guide and drive members many thousands of times.

Any suitable crystalline particle having reactive hydroxyl groups chemically attached to metal or metalloid atoms on the outer surface of the crystalline particles may be employed. The expression "crystalline" is defined as an inorganic material having a regular shape determined by an orderly three-dimensional atomic lattice work. Typical metal and metalloid atoms include silicon, titanium, zirconium, aluminum, and the like. The crystalline particles may have any suitable outer shape. Typical outer shapes include irregular, granular, elliptical, cubic, flake, and the like. The crystalline particles should have a hardness greater than about 2.5 Mohs for satisfactory improvement in resistance to wear and preferably greater than 4.5 Mohs for optimum operating longevity. Typical crystalline particles include euhedral quartz crystal, sandstone, quartzite sand, quartz rock, novaculite, silicon dioxide, aluminum oxide, titanium dioxide, and the like. Preferably, the crystalline particles should have a particle size less than the thickness of the electrically conductive ground strip layer to avoid an electrically conductive ground strip layer having an excessively irregular outer surface. An average crystalline particle size between about 0.3 micrometer and about 5 micrometers is preferred to a achieve a relatively smooth outer surface which does not unduly abrade and prematurely shorten the life of the contacting grounding devices.

Generally, for flexible electrostatographic imaging members, the electrically conductive ground strip layer comprises from about 5 percent by weight to about 20 percent by weight of crystalline particles, based on the total weight of the dried electrically conductive ground strip layer. A concentration of crystalline particles greater than about 20 percent by weight tends to render the electrically conductive ground strip layer inadequately conductive for practical use as a ground plane and, for flexible imaging members, unduly reduces the flexibility of the electrically conductive ground strip layer. Preferably, the crystalline particles should have a particle size less than the thickness of the ground strip layer to avoid an ground strip layer having an irregular outer surface. An average crystalline particle size between about 0.3 micrometer and about 5 micrometers is preferred to achieve a relatively smooth outer surface which does not unduly abrade and prematurely shorten the life of contacting grounding devices. Conductive ground strip layers of this invention have been prepared that are sufficiently flexible to bend around a 0.59 inch (1.5 cm) diameter tube without mechanical failure such as cracking or separation from the conductive layer. An optimum combination of flexibility, wear and electrical properties are achieved with a concentration of from about 10 percent by weight and about 15 percent by weight of crystalline particles, based on the total weight of the dried electrically conductive ground strip layer. When less than about 5 percent by weight of the crystalline particles are utilized, the improvement in wear resistance is relatively slight.

Any suitable bi-functional chemical coupling agent may be employed to treat the surface of the crystalline particles. The bi-functional chemical coupling agent comprises in a single molecule at least one reactive group which will react with hydroxyl groups on the surface of the crystalline particles and at least one organo functional reactive group which will react with reactive groups on the film forming binder molecules. Selection of the organo functional reactive group for the bi-functional coupling agent molecule depends on the reactive groups present on the film forming resin molecule to employed. Typical reactive groups on the bi-functional chemical coupling agent that react with reactive groups on thermoplastic resins include vinyl, amino, azido, amino, epoxide, halogen, sulfite, and the like. Thus, the crystalline particles and bi-functional coupling agent are chemically bonded to each other through an oxygen atom and the bi-functional coupling agent and film forming binder are also chemically bonded to each other. Typical reactive groups on bi-functional coupling agents which will react with the hydroxy groups on the surface of the crystalline particles include alkoxy, acetoxy, hydroxy, carboxy and the like. The hydrolyzable groups on the coupling agents react directly, chemically attaching themselves to the particles. For example, for crystalline silica particles, the hydrolyzable ends of the bi-functional silane coupling agents attach to the hydroxyl groups on the outer surface of the crystalline particles via silanol (SiOH) groups formed through hydrolysis of the hydrolyzable groups. Typical bi-functional chemical coupling agents include organosilanes having these characteristics include amino silanes such as 3-aminopropyl triethoxy silane, (N,N'-dimethyl 3-amino)propyl triethoxysilane, N,N-dimethylamino phenyl triethoxy silane, N-phenyl aminopropyl trimethoxy silane, trimethoxy silylpropyldiethylene triamine, N-aminoethyl-3-aminopropyltrimethoxysilane, N-(2-aminoethyl)-3-aminopropyltrimethoxysilane, N-2-aminoethyl-3-aminopropyltris(ethylhethoxy)silane, p-aminophenyl trimethoxysilane, 3-aminopropyldiethylmethylsilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-propionate, (N,N'-dimethyl 3-amino)propyl triethoxysilane, and 3[2(vinyl benzylamino)ethylamino]propyltrimethoxy silane; halo silanes such as chloropropyltriethoxysilane and (3-chloropropyl)trimethoxy silane; vinyl silanes such as vinyl triethoxy silane, triacetoxyvinyl silane, tris(2-methoxyethoxy)vinyl silane and 3-methacryloxypropyltrimethoxy silane; epoxy silanes such as [2-(3,4-epoxycyclohexylethyltrimthoxy silane; mercaptosilanes such as azido compounds such as AX-CMP MC azido silane and azidotrimethoxy silane, organotitanates, such as neoalkoxy, tri(dioctylphosphato titanate), neoalkoxy, tri(N ethylaminoethylamino)titanate, neoalkoxy, tri(m-amino)phenyl titanate and isopropyl di(4amino benzoyl-)isostearoly titanate; organozirconates such as neoalkoxy trisneodecanoyl zirconate, neoalkoxy tris(dioctyl)-phosphato zirconate, neoalkoxy tris(dioctyl)pyrphosphata zirconate, neoalkoxy tris(ethylene diamino)ethyl zirconate, neoalkoxy tris(m-amino)phenyl zirconate; and the like and mixtures thereof.

These coupling agents are usually applied to the crystalline particles prior to dispersion of the crystalline particles into the film forming binder. Any suitable technique may be utilized to apply and react the coupling agent with the surface of the crystalline particles. The deposited coupling agent coating on the crystalline particles are continuous, thin, and preferably in the form of a monolayer. A preferred process for applying the bi-functional chemical coupling agent to the crystalline particles is by stirring the crystalline particles in an aqueous solution of a hydrolyzed silane. After thoroughly wetting the surface of the crystalline particles with the aqueous solution to ensure reaction between the reactive groups on the coupling agent molecule and the hydroxyl groups on the outer surface of the crystalline particles, the treated crystalline particles may be separated from the aqueous solution by any suitable technique such as filtering. The treated crystalline particles may thereafter be dried, if desired, by conventional means such as oven drying, forced air drying, combinations of vacuum and heat drying, and the like. Other techniques of silylation such as contacting the outer surface of the crystalline particles with vapors or spray containing the bifunctional coupling agent may also be employed. For example, sylylation may be accomplished by pouring or spraying the bi-functional chemical coupling onto the crystalline particles while the crystalline particles are agitated in a high intensity mixer at an elevated temperature. In this blending technique, the coupling agent is reacted with the hydroxyl groups directly attached to metal or metalloid atoms at the surface of the crystalline particles to form a reaction product in which the crystalline particles and the bi-functional coupling agent are chemically bonded to each other through an oxygen atom. Such a process is described, for example, in U.S. Pat. No. 3,915,735, the disclosure of which is incorporated herein by reference in its entirety.

Generally, the concentration of the bi-functional coupling agent in the treating solution should be sufficient to provide at least a continuous mono molecular layer of coupling agent on the surface of the crystalline particles. Satisfactory results may be obtained with an aqueous solution containing from about 1 percent by weight to about 5 percent by weight of coupling agent based on the weight of the solution. After drying, the crystalline particles coated with the reaction product of the bi-functional coupling agent and hydroxyl groups attached to the metal or metalloid atoms onthe outer surface of the crystalline particles are dispersed in the film forming binder where further reaction occurs between the reactive organo functional groups of the bi-functional coupling agent and reactive groups on the film forming binder molecules. Dispersion may be effected by any suitable conventional mixing technique such as blending the treated silica particles with a molten thermoplastic resin or in a solution of the resin in a solvent.

Typical combinations of bi-functional chemical coupling agents and film forming binder polymers having reactive groups include 3-aminopropyl triethoxy silane and polycarbonate; tris(2-methoxyethoxyl)vinyl silane and polyethylene; 4-aminopropyl triethoxy silane and nylon; [3-(2-aminoethylamino)propyl]trimethoxy silane and nylon; 3-methacryloxypropyltrimethoxy silane and polyester; (3-glycidoxypropyl)trimethoxy silane and polycarbonate; 4-aminopropyl triethoxy silane and poly(vinylchloride); vinyltris(2-methoxyethoxy)silane and polystyrene; and the like.

Aminosilane bi-functional chemical coupling agents are preferred because the amine functionality forms an excellent bond through its reaction with the COOH and OH groups of the film forming binder polymer and excellent bonding with the underlying layer is achieved. These silanes are applied in hydrolyzed form because the OH groups of the silane will readily condense with the silanol groups on the crystalline particle surfaces and position the organofunctional amine group of the silane for reaction with the reactive group on the film forming binder polymer.

The preferred hydrolyzed silane has the general formula:

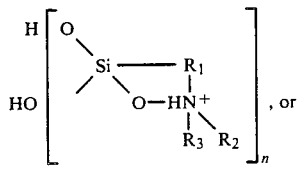

I

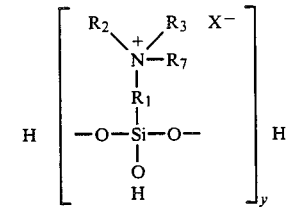

II or mixtures thereof, wherein $R_1$ is an alkylidene group containing 1 to 20 carbon atoms, $R_2$,$R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4.

The hydrolyzed silane may be prepared by hydrolyzing an aminosilane having the following structural formula:

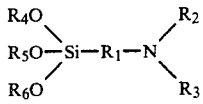

wherein R1 is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable aminosilanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylhethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)-propyltriethoxysilane, or mixtures thereof because the hydrolyzed solutions of these materials exhibit a greater degree of basicity and stability and because these materials are readily available commercially.

If $R_1$ is extended into a long chain, the compound becomes less stable. Silanes in which $R_1$ contains about 3 to about 6 carbon atoms are preferred because the oligomer is more stable. Optimum results are achieved when $R_1$ contains 3 carbon atoms. Satisfactory results are achieved when $R_2$ and $R_3$ are alkyl groups. Optimum stable solutions are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate structure:

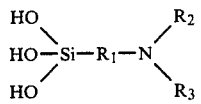

After drying, the reaction product layer formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution utilized to treat the crystalline particles may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the selenium pigment or particles. The thickness of the reaction product layer is estimated to be between about 20 Angstroms and about 2,000 Angstroms.

A solution pH between about 4 and about 14 may be employed. Optimum reaction product layers on the crystalline particles are achieved with hydrolyzed silane solutions having a pH beween about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of hydrolyzed silane may also contain additives such as polar solvents other than water to promote the silylation process for the crystalline particles. Typical polar solvents include methanol, ethanol, isopropanol, tetrahydrofuran, methoxyethanol, ethoxyethanol, ethylacetate, ethylformate and mixtures thereof. p Any suitable technique may be utilized to treat the crystalline particles with the reaction product of the hydrolyzed silane. For example, washed crystalline silica can be swirled in a hydrolyzed silane solution for between about 1 minute and about 60 minutes and then the solids thereafter allowed to settle out and remain in contact with the hydrolyzed silane for between about 1 minute and about 60 minutes. The supernatent liquid may then be decanted and the treated crystalline silica filtered with filter paper. The crystalline silica may be dried at between about 1 minute and about 60 minutes at between about 80° C. and about 135° C. in a forced air oven for between about 1 minute and about 60 minutes.

Crystalline particles treated with bi-functional silane coupling agents are also commercially available. For example, crystalline silica particles reacted with an amino silane are available as SSO212 from Petrarch Systems, Inc. and crystalline silica particles reacted with 3-chloropropyltrimethoxy silane are available as SSO214 from Petrarch Systems, Inc.

Any suitable conventional coating technique may be utilized to apply the ground strip layer to the supporting substrate layer. Typical coating techniques include solvent coating, extrusion coating, spray coating, lamination, dip coating, solution spin coating and the like. The conductive ground strip layer may be applied directly onto the conductive layer, onto the blocking layer, onto the adhesive layer, and/or partially over the charge generating layer to achieve sufficient electrical contact with the conductive layer. Generally, the blocking and adhesive layers are sufficiently thin to allow electrical contact to occur between the conductive layer and the conductive ground strip layer even though the conductive layer and conductive ground strip layer do not actually physically contact each other. The conductive ground strip layer may be applied prior to, simultaneously with, or subsequent to the application of any of the other layers on the conductive layer. The important criteria is that suifficient electrical contact be achieved to secure an electrically conductive path between an external source of potential and the conductive layer of the imaging member through the conductive ground strip layer. Excellent results may be obtained by coextruding an imaging layer and the electrically conductive ground strip layer as described, for example, in U.S. Pat. No. 4,521,457. The entire disclosure of this patent is incorporated herein by reference. The deposited ground strip layer may be dried by any conventional drying technique such as oven drying, forced air drying, circulating air oven drying, radiant heat drying, and the like.

The thickness of the electrically conductive ground strip layer should be sufficient to provide a durable electrically conductive layer. For flexible ground strip layers, the thickness should be thin enough to avoid mechanical failure such as cracking or separation from the underlying layer during passage over rollers and rods. Generally, the thickness of the electrically conductive ground strip layer is equal to or less than that of the imaging layer or layers to avoid interference with processing stations during imaging. For example, for an electrophotographic imaging member in which the imaging layer has a thickness of about 26 micrometers on an aluminized Mylar substrate having a thickness of about 76 micrometers, excellent results have been achieved with a 15 micrometers thick electrically conductive ground strip layer containing polycarbonate resin, ethylcellulose, graphite and the bifunctional coupling agent treated crystalline particles of this invention.

Optimum results are obtained when the electrically conductive ground strip layer coating mixture has a crystalline particle concentration of between about 10 percent by weight and about 15 percent by weight crystalline particles based on the total weight of the dried electrically conductive ground strip layer and a solvent for the resin which has a high vapor pressure. When this coating mixture is applied to the supporting substrate, the solvent evaporates rapidly from the thin film and immobilizes the crystalline particles in the polymer matrix to form a layer in which the crystalline particles are homogeneously dispersed throughout the thickness of the film. This is particularly desirable for a uniform rate of wear during the life of the imaging member.

Surprisingly, the use of the bi-functinal coupling agent treated crystalline particles of this invention provide significantly superior results in ground strip layers compared to ground strip layers without the crystalline particles. Moreover, the use of the bi-functional coupling agent treated crystalline particles such as aminosilane treated crystalline silica provide markedly better results than amorphous particles such as amorphous silica. The ground strip layers of this invention greatly extend photoreceptor mechanical and electrical life, particularly in systems using abrasive grounding devices such as metallic brushes and sliding metal contacts. For example, mechanical life for a composite photoreceptor was increased by more than 300 percent when subjected to abrasive contact with a pair of stainless steel grounding brushes from a Xerox 1075 electrophotographic duplicator. Moreover, the amount of conductive opaque dirt formed during machine operation is markedly reduced. Surprisingly, the ground strip layer of this invention does not exhibit any significant reduction of conductivity when up to about 10 weight percent of silica is added.

A number of examples are set forth hereinbelow and, other than the control examples, are illustrative of different compositions and conditions that can be utilized in practicing the invention. All proportions are by weight unless otherwise indicated. It will be apparent, however, that the invention can be practiced with many types of compositions and can have many different uses in accordance with the diclosure above and as pointed out hereinafter.

EXAMPLE I

A photoconductive imaging member was prepared by providing a titanium coated polyester (Melinex, available from ICI Americas Inc.) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available for E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of 1/8 inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. However, a strip about 3 mm wide along one edge of the substrate, blocking layer and adhesive layer was deliberately left uncoated by any of the photogenerating layer material to facilitate adequate electrical contact by the ground strip layer that is applied later. This photogenerating layer was dried at 135° C. for 5 minutes in a forced air oven to form a dry thickness photogenerating layer having a thickness of 2.0 microns.

This coated member was simultaneously overcoated with a charge transport layer and ground strip layer by coextrusion of the coating materials through adjacent extrusion dies similar to the dies described in U.S. Pat. No. 4,521,457. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A.G. The resulting mixture was dissolved in 15 percent by weight methylene chloride. This solution was applied on the photogenerator layer by extrusion to form a coating which upon drying had a thickness of 25 micrometers.

The strip about 3 mm wide of the adhesive layer left uncoated by the photogenerator layer was extrusion coated with a ground strip layer. The ground strip layer coating mixture was prepared by combining 5.25 lbs. of polycarbonate resin (Makrolon 5705, 7.87 percent by total weight solids, available from Bayer AG), and 73.17 lbs of methylene chloride in a carboy container. The container was covered tightly and placed on a roll mill for about 24 hours until the polycarbonate was dissolved in the methylene chloride. The resulting solution was mixed for 15–30 minutes with about 20.72 lbs. of a graphite dispersion (12.3 Percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325–375 centipoises with the aid of methylene chloride. This ground strip layer coating mixture was then applied to the photoconductive imaging member to a form an electrically conductive ground strip layer having a dried thickness of about 12 to 16 micrometers.

During the transport layer and ground strip layer coating process the humidity was equal to or less than 15 percent. The resulting photoreceptor device containing all of the above layers was annealed at 135° C. in a forced air oven for 6 minutes.

Except for the type of ground strip layer employed, the procedures described in this Exaple were used to prepare the photoreceptors described in the Examples II through below.

EXAMPLE II

A photoconductive imaging member having two electrically operative layers as described in Example I was prepared using the same procedures and materials except that a ground strip layer of this invention was substituted for the ground strip layer described in Example I. The substituted ground strip layer coating was prepared by combining 5.25 lbs. of polycarbonate resin (Makrolon 5705, 8.66 percent by weight solids, available from Bayer AG) and 73.17 lbs. of methylene chloride in a carboy container. The container was covered tightly and placed on a roll mill for about 24 hours until the polycarbonate was dissolved in the methylene chloride. The resulting solution was mixed for 15–30 minutes with about 20.72 lbs. of a dispersion (12.3 Percent by weight solids) of 9.43 parts by weight graphite, 2.87 parts by weight ethylcellulose and 87.7 parts by weight solvent (Acheson Graphite dispersion RW22790, available from Acheson Colloids Company) and 0.86 lbs. of 3-aminopropyl triethoxy silane treated crystalline silica particles having a particle size less than about 5 micrometers (Novakup GA-1 silica, available from Malvern Minerals Company) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325–375 centipoises with the aid of methylene chloride. This ground strip layer coating mixture was then applied to the photoconductive imaging member to a form an electrically conductive ground strip layer having a dried thickness between about 12 16 micrometers in the same manner as that described in Example I. The silica content is about 19 percent by weight based on the weight of the dried layer. The treated crystalline silica particles comprise the reaction product of the hydrolyzed silane and silanol groups on the surface of the silica particles.

EXAMPLE III

The procedures of Example I were repeated with the same materials as used in Example I except that the final dried ground strip thickness was 12 micrometers.

EXAMPLE IV

The procedures of Example I were repeated with the same materials as used in Example I except that the final dried ground strip thickness was 15 micrometers.

EXAMPLE V

The procedures of EXAMPLE II were repeated with the same materials as used in Example II except that the concentration of the treated crystalline silica particles in the final dried ground strip was 2.5 percent based on the total weight of the final dried ground strip and the final ground strip thickness was 11 micrometers.

EXAMPLE VI

The procedures of Example II were repeated with the same materials was used in Example II except that the concentration of the treated crystalline silica particles in the final dried ground strip was 2.5 percent based on the total weight of the final dried ground strip and the final ground strip thickness was 15 micrometers.

EXAMPLE VII

The procedures of Example II were repeated with the same materials as used in Example II except that the concentration of the treated crystalline silica particles in the final dried ground strip was 5 percent based on the total weight of the final dried ground strip and the final ground strip thickness was 12 micrometers.

EXAMPLE VII

The procedures of Example II were repeated with the same materials as used in Example II except that the concentration of the treated crystalline silica particles in the final dried ground strip was 5 percent based on the total weight of the final dried ground strip and the final ground strip thickness was 14 micrometers.

EXAMPLE IX

The procedures of Example II were repeated with the same materials as used in Example II except that the concentration of the treated crystalline silica particles in the final dried ground strip was 7.5 percent based on the total weight of the final dried ground strip and the final ground strip thickness was 12 micrometers.

EXAMPLE X

The procedures of Example II were repeated with the same materials as used in Example II except that the concentration of the treated crystalline silica particles in the final dried ground strip was 7.5 percent based on the total weight of the final dried ground strip and the final ground strip thickness was 15 micrometers.

EXAMPLE XI

The procedures of Example II were repeated with the same materials as used in Example II except that the concentration of the treated crystalline silica particles in the final dried ground strip was 10 percent based on the total weight of the final dried ground strip and the final ground strip thickness was 12 micrometers.

EXAMPLE XII

The procedures of Example II were repeated with the same materials as used in Example III–IX except that the concentration of the treated crystalline silica particles in the final dried ground strip was 10 percent based on the total weight of the final dried ground strip, the ground strip layer was applied with a Dilts coater, and the final ground strip thickness was 14 micrometers.

EXAMPLE XIII

A photoconductive imaging member having two electrically operative layers as described in Example I was prepared using the same procedures and materials except that a ground strip layer of this invention was substituted for the ground strip layer described in Example I. The substituted ground strip layer coating was prepared by combining 12.0 lbs. of pellets containing 20 parts by weight carbon black and 80 parts by weight polycarbonate (Reed CPY 03581, available from Reed Plastics Corp.) and 74.4 lbs. of methylene chloride in a carboy container. The container was covered tightly and placed on a roll mill for about 24 hours until the polycarbonate was dissolved in the methylene chloride. The resulting mixture was mixed for 15–30 minutes with about 1.3 lbs. of 3-aminopropyl triethoxy silane treated crystalline silica particles having a particle size less than about 5 micrometers (Novakup GA-1silica, available from Malvern Minerals Company) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325–375 centipoises with the aid of cyclohexanone. This ground strip layer coating mixture was then aplied to the photoconductive imaging member to a form an electrically conductive ground strip layer having a dried thickness of about 14 micrometers in the same manner as that described in Exmple I. The treated crystalline silica particles comprise the reaction product of the hydrolyzed silane and silanol groups on the surface of the silica particles.

EXAMPLE XIV

The electrophotographic imaging members of Examples II–XII were taped onto Mylar belts having loop length of about 42 inches (106.6 cm.) Wear tests were conducted on these belts in a fixture under relatively stressful conditions of 105° F. at 85 percent relative humidity. The test device utilized two stationary stainless steel grounding brushes from a Xerox 1075 duplicator applied against the ground strip layers of Examples II–XII with a load of 400 gm on each brush. The normal load on these brushes in a Xerox 1075 machine is about 200 gm per brush. The rate of passage of the electrophotographic imaging members under the brushes was one cycle per sec. The results of the wear test are illustrated below in Table I.

TABLE I

| Example | Weight Percent Silica | Thickness (micrometers) | Cycles | Results |
|---|---|---|---|---|
| III | 0 | 12 | 150,000 | Failure |
| IV | 0 | 15 | 185,000 | Failure |
| V | 2.5 | 11 | 533,000 | (No failure) |
| VI | 2.5 | 15 | 533,000 | (No failure) |
| VII | 5.0 | 12 | 533,000 | (No failure) |
| VIII | 5.0 | 14 | 533,000 | (No failure) |
| IX | 7.5 | 12 | 533,000 | (No failure) |
| X | 7.5 | 15 | 533,000 | (No failure) |
| XI | 10 | 12 | 533,000 | (No failure) |
| XII | 10 | 14 | 533,000 | (No failure) |
| XIII | 10 | 14 | 533,000 | (No failure) |

Ground strip layer failure was determined to be the point in time when the wearing away of the ground strip layer exposed the underlying conductive layer. The tests for the electrophotographic imaging members of Examples V–XIII were terminated at 535,000 cycles with no signs of ground strip layer failure. Thus, the life of the ground strip layers of Examples V–XI was improved more than 196 to 255 percent over that of the control ground strip layers and the life of the ground strip layer of Examples XII was 116 to 167 percent grater than that of the control ground strip layers.

EXAMPLE XV

The procedures of Example I were repeated with the same materials as used in Example I to prepare an electrophotographic imaging belt having no treated crystalline silica particles in the final dried ground strip. The final ground strip had a thickness 14 micrometers and a width of about 2 cm. The ground strip of this imaging member was tested in a device which pressed two flexible metal sliding contacts against the ground strip layer of the photoreceptor. The photoreceptor had a width of 16 inches and a circumference of 42 inches and was supported by four rollers, the flexible sheet metal contacts were bent into a hook-like shape with the bnd on the hook being pressed against the surface of the grounding strip. Each hook had a width of 4 mm and a radius of curvature of 7 mm. The distance between the two hook shaped contacts was 23 mm. Sufficient pressure was applied by the two sliding contacts to depress the belt about 2 mm at a point about 19 cm from a roller support on one side of the point of contact and about 25.4 cm from the other roller on the other side of the point of contact. The belt velocity was maintained at about 10.5 inches per second under the belt tension of about 1 pound per linear inch across the width of the belt. The wear experiments were carried out under relatively stressful conditions of about 85° F. at 70 percent relative humidity. The average ground strip wear life (point where the underlying conductive layer was exposed) for the control was between 55,000 and 65,000 cycles.

EXAMPLE XVI

The procedures of Example II were repeated with the same materials as used in Example II to prepare an electrophotographic imaging belt having a concentration of the treated crystalline silica particles in the final dried ground strip of 10 percent based on the total weight of the final dried ground strip, a final ground strip thickness of 14 micrometers and a width of about 1 cm. The ground strip of this imaging member was tested in a device which pressed two flexible metal sliding contacts against the ground strip layer of the photoreceptor exactly as described in Example XIV. The photoreceptor with 10 percent treated crystalline silica in the ground strip had an average wear life about 130,00 to 230,00 cycles. Thus, the improvement in wear ranged from about 200 percent to about more than 400 percent over that of the control described in Example XIV.

EXAMPLE XVII

A photoconductive imaging member was prepared by providing a titanium metalized Mylar substrate having a thickness of 3 mils and applying thereto, using a Bird applicator, a solution containing 2.59 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by applying to the blocking layer was coating having a wet thickness of 0.5 mil and containing 0.5 percent by weight based on the total weight of the solution DuPont 49,000 adhesive in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1-biphenyl-4,4'-diamine, and 67.5 percent by volume polyvinycarbazole.

This photogenerating layer was prepared by introducing 0.8 gram polyvinyl carbazole and 14 ml of a 1:1 volume ratio of a mixture of tetrahydrofuran and toluene into a 2 oz, amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. A strip about 3 mm wide of the adhesive layer left uncoated by the transport layer for coating with a ground strip layer. The layer was dried at 135° C. for 5 minutes in a forced air oven to form a dry thickness photogenerating layer having a thickness of 2.0 microns.

This coated member was simultaneously overcoated with a charge transport layer and ground strip layer by coextrusion of the coating materials through adjacent extrusion dies similar to the dies described in U.S. Pat. No. 4,521,457. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon, a polycarbonate resin having a molecular weight of from about 50,000 to 100,000 commercially available from Larbensabricken Bayer A.G. The resulting mixture was dissolved in 15 percent by weight methylene chloride. This solution was applied on the photogenerator layer by extrusion to form a coating which upon drying had a thickness of 25 microns.

The strip about 3 mm wide of the adhesive layer left uncoated by the photogenerator layer was extrusion coated with a ground strip layer. The ground strip layer coating mixture was prepared by combining 2,383.5 grams of polycarbonate resin (Makrolon 5705, available from Bayer AG), and 33,219.2 grams of methylene chloride solvent in a carboy container. The container was covered tightly and placed on a roll mill for about 24 hours until the polycarbonate resin was dissolved in the solvent. The resulting solution was mixed for 15–30 minutes with about 9,406.9 grams of a graphite dispersion of 9.43 parts by weight graphite, 2.87 parts by weight ethyl cellulose and 87.7 parts by weight solvent (Acheson Grahpite dispersion, available from Acheson Colloid Co.) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325–375 centipoises with the aid of methylene chloride. This ground strip layer coating mixture was then applied to the photoconductive imaging member to a form an electrically conductive group strip layer having a dried thickness of about 14 micrometers.

During the transport layer and ground strip layer coating process the humidity was equal to or less than 15 percent. The resulting photoreceptor device containing all of the above layers was annealed at 135° C. in a forced air oven for 6 minutes.

Except for the type of ground strip layer employed, the procedures described in this Example were used to prepare the photoreceptors described in the Examples below.

EXAMPLE XVIII

A photoconductive imaging member having two electrically operative layers as described in Example XVII was prepared using the same procedures and materials except that a ground strip layer of this invention was substituted for the ground strip layer described in Example XVI. The substituted ground strip layer coating was prepared by combining 2,383.5 grams of polycarbonate resin (Makrolon 5705, available from Bayer AG) and 33,219.2 grams of methylene chloride in a carboy container. The container was covered tightly and placed on a roll mill for about 24 hours until the polycarbonate resin was dissolved in the methylene chloride. The resulting solution was mixed for 15–30 minutes with about 9,406.9 grams of a dispersion of 9.43 parts by weight graphite, 2.87 parts by weight ethyl cellulose and 87.7 parts by weight solvent (Acheson Graphite Dispersion, available from Acheson Colloid Co.) and 390.4 grams of 3-aminopropyltriethoxy silane treated crystalline silica particles having a particle size less than about 5 micrometers (Novakup GA-1, available from Malvern Minerals Co.) with the aid of a high shear blade disperser (Tekmar Dispax Disperser) in a water cooled, jacketed container to prevent the dispersion from overheating and losing solvent. The resulting dispersion was then filtered and the viscosity was adjusted to between 325–375 centipoises with the aid of methylene chloride. This ground strip layer coating mixture was then applied to the photoconductive imaging member to a form an electrically conductive ground strip layer having a dried thickness Of about 14 micrometers in the same manner as that described in Example XVI. The treated crystalline silica particles comprise the reaction product of the hydrolyzed silane and hydroxyl groups on the surface of the silica particles.

EXAMPLE XIX

The ground strip layer coatings in Examples XVI through XVIII were tested for electrical conductivity and wear resistance. The tests results showed that 10 percent by weight of crystalline silica particles treated with a reaction product of a bifunctional coupling agent added to the ground strip layer exhibited a bulk electrical resistivity of less than $10^4$ ohm cm and provided enhanced ground strip wear resistance against abrasive interaction with a pair of stainless steel grounding brushes and sliding metal grounding contact members by a factor of 2 to 4 compared to that of the control of Examples XV and XVII. The incorporation of 10 percent by weight of crystalline silica particles treated with a reaction product of a bifunctional coupling agent also did not change the effect of the ground strip on photoconductive imaging member curl.

EXAMPLE XXX

The procedures of Example II were repeated with the same materials as used in Example II to prepare an electrophotographic imaging web having a concentration of the treated crystalline silica particles in the final dried ground strip of 10 percent based on the total weight of the final dried ground strip, a final ground strip thickness of 14 micrometers. The ground strip of this imaging member was tested for ground strip adhesion. A cross hatch pattern was formed on the ground strip layer by cutting through the thickness of the ground strip layer with a razor blade. The cross hatch pattern consisted of perpendicular slices 5 mm apart to form tiny separate squares of the ground strip layer. Adhesive tapes were then pressed against the ground strip layer and thereafter peeled from the ground strip layer. The tests were made with two different adhesive tapes. One tape was Scotch Brand Magic Tape #810, available from 3M Corporation having a width of 0.75 in and the other tape was Fas Tape #445, available from Fasson Industrial Div., Avery International. After application of the tapes to the ground strip layer, one tape of each brand was peeled in a direction perpendicular to the surface of the ground strip layer and one tape of each brand was peeled in a direction parallel to the outer surface of the same tape still adhering to the surface of the ground strip layer. Peeling off of the tapes failed to remove any of the ground strip layer from the underlying layers thereby demonstrating the excellent adhesion of the ground strip layer to the underlying layers.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrostatographic imaging member comprising at least one electrophotographic imaging layer, a supporting substrate layer having an electrically conductive surface and an electrically conductive ground strip layer adjacent said electrostatographic imaging layer and in electrical contact with said electrically conductive surface, said electrically conductive ground strip layer comprising a film forming binder, conductive particles, crystalline silica particles dispersed in said film forming binder, and a chemical reaction product of an amino silane bi-functional chemical coupling agent with both said film forming binder and said crystalline particles, said crystalline silica particles and said amino silane bi-functional coupling agent being chemically bonded to each other through an oxygen atom by a chemical reaction between reactive hydroxyl groups chemically attached to said silica particles and reactive groups on molecules of said amino silane bi-functional coupling agent, and said amino silane bi-functional chemical coupling agent and said film forming binder being chemically bonded to each other by a chemical reaction between organo functional reactive groups on molecules of said amino silane bi-functional chemical coupling agent and reactive groups on molecules of said film forming binder.

2. An electrostatographic imaging member comprising at least one imaging layer capable of retaining an electrostatic latent image, a supporting substrate layer having an electrically conductive surface and an electrically conductive ground strip layer adjacent said electrostatographic imaging layer and in electrical contact with said electrically conductive surface, said electrically conductive ground strip layer comprising a film forming binder, conductive particles, crystalline silica particles dispersed in said film forming binder, and a chemical reaction product of an amino silane bi-functional chemical coupling agent with both said film forming binder and said crystalline particles, said crystalline silica particles and said amino silane bi-functional coupling agent being chemically bonded to each other through an oxygen atom by a chemical reaction between reactive hydroxyl groups chemically attached to said silica particles and reactive groups on molecules of said amino silane bi-functional coupling agent, and said amino silane bi-functional chemical coupling agent and said film forming binder being chemically bonded to each other by a chemical reaction between organo functional reactive groups on molecules of said amino silane bi-functional chemical coupling agent and reactive groups on molecules of said film forming binder.

3. An electrostatographic imaging member comprising at least one imaging layer capable of retaining an electrostatic latent image, a supporting substrate layer having an electrically conductive surface and an electrically conductive ground strip layer adjacent said electrostatographic imaging layer and in electrical contact with said electrically conductive surface, said electrically conductive ground strip layer comprising a film forming binder, conductive particles, crystalline particles dispersed in said film forming binder, and a reaction product of a bi-functional chemical coupling agent with both said film forming binder and said crystalline particles, said crystalline particles having metal or metalloid atoms located on the outer surface of said crystalline particles, said crystalline particles and said bi-functional coupling agent being chemically bonded to each other through an oxygen atom by a chemical reaction between reactive hydroxyl groups chemically attached to said metal or metalloid atoms and reactive groups on molecules of said bi-functional coupling agent, and said bi-functional chemical coupling agent and said film forming binder being chemically bonded to each other by a chemical reaction between organo functional reactive group, on molecules of said bi-functional chemical coupling agent and reactive groups on molecules of said film forming binder.

4. An electrostatographic imaging member according to claim 3 wherein said imaging layer comprises an electrophotographic imaging layer.

5. An electrostatographic imaging member according to claim 3 wherein said electrophotoconductive imaging layer comprises a charge generating layer and a charge transport layer.

6. An electrostatographic imaging member according to claim 3 wherein said imaging layer comprises a dielectric imaging layer.

7. An electrostatographic imaging member according to claim 3 wherein said electrically conductive ground strip layer comprises between about 5 percent by weight and about 20 percent by weight of said crystalline particles based on the total dry weight of said ground strip layer, said crystalline particles having a particle size less than the thickness of said electrically conductive ground strip layer and said ground strip layer having a volume resistivity of less than about $1\times10^8$ ohm cm.

8. An electrostatographic imaging member according to claim 3 wherein said crystalline particles are crystalline silica particles and said bi-functional chemical coupling agent is an amino silane.

9. An electrostatographic imaging member according to claim 3 wherein said bi-functional chemical coupling agent is a hydrolyzed silane having the general formula:

I

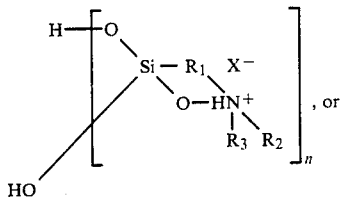

, or

II

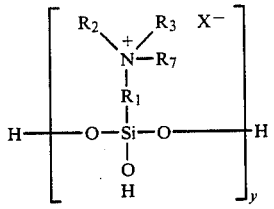

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4.

10. An electrostatographic imaging member according to claim 3 wherein said bi-functional chemical coupling agent is an aminosilane having the following structural formula:

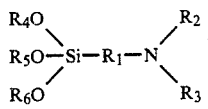

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms.

11. An electrostatographic imaging member according to claim 3 wherein said charge transport layer comprises an organic polymer and an aromatic amine compound having the general formula:

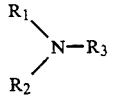

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

12. An electrostatographic imaging member according to claim 3 wherein said supporting layer comprises a flexible resin layer coated with a thin flexible conductive layer, said film forming binder comprises a thermoplastic resin having a $T_g$ of at least about 40° C. and the particle size of said crystalline particles is between about 0.3 micrometer and about 5 micrometers.

13. An electrostatographic imaging member according to claim 3 wherein said crystalline particles have a hardness grearer than about 2.5 Mohs.

14. An electrostatographic imaging member according to claim 3 wherein said bi-functional chemical coupling agent and said film forming binder are chemically bonded to each other by a chemical reaction between organo functional reactive groups on molecules of said bi-functional chemical coupling agent and reactive groups on molecules of said film forming binder selected from the group consisting of COOH, OH, vinyl, amino, amide, epoxide and carbonyl groups.

15. An electrostatographic imaging process comprising providing an electrostatographic imaging member comprising at least one imaging layer capable of retaining an electrostatic latent image on an imaging surface, a supporting substrate layer having an electrically conductive surface and an electrically conductive ground strip layer adjacent said electrostatographic imaging layer and in electrical contact with said electrically conductive surface, said electrically conductive ground strip layer comprising a film forming binder, conductive particles, crystalline particles dispersed in said film forming binder and a reaction product of a bi-functional chemical coupling agent with both said film forming binder and said crystalline particles, said crystalline particles having metal or metalloid atoms located on the outer surface of said crystalline particles, said crystalline particles and said bi-functional coupling agent being chemically bonded to each other through an oxygen atom by a chemical reaction between reactive hydroxyl groups chemically attached to said metal or metalloid atoms and reactive groups on molecules of said bi-functional coupling agent, and said bi-functional chemical coupling agent and said film forming binder being chemically bonded to each other by a chemical reaction between organo functional reactive groups on molecules of said bi-functional chemical coupling agent and reactive groups on molecules of said film forming binder, forming an electrostatic latent image on said imaging surface, forming a toner image on said imaging surface in conformance with said electrostatic latent image and transferring said toner image to a receiving member.

16. An electrostatographic imaging process according to claim 15 comprising frictionally contacting said electrically conductive ground strip layer with an electrically conductive member while forming said electrostatic latent image on said imaging surface, forming said toner image, and transferring said toner image to said receiving member.

* * * * *